US007717667B2

(12) United States Patent
Urbassik et al.

(10) Patent No.: US 7,717,667 B2
(45) Date of Patent: May 18, 2010

(54) METHOD AND APPARATUS FOR OPERATING GAS TURBINE ENGINES

(75) Inventors: Ryan Michael Urbassik, Cincinnati, OH (US); Scott Anthony Estridge, Cincinnati, OH (US); Rafael Ruiz, Liberty Township, OH (US); Robert Proctor, West Chester, OH (US); Robert J. Albers, Park Hills, KY (US); Kevin Stephen Hansell, Okeana, OH (US)

(73) Assignee: General Electric Company, Schenectady, NY (US)

( * ) Notice: Subject to any disclaimer, the term of this patent is extended or adjusted under 35 U.S.C. 154(b) by 809 days.

(21) Appl. No.: 11/541,715

(22) Filed: Sep. 29, 2006

(65) Prior Publication Data

US 2008/0080967 A1 Apr. 3, 2008

(51) Int. Cl.
*F04D 31/00* (2006.01)
*F01D 11/24* (2006.01)

(52) U.S. Cl. ..... 415/1; 415/116

(58) Field of Classification Search ..... 415/1, 415/116

See application file for complete search history.

(56) References Cited

U.S. PATENT DOCUMENTS 4,069,661 A * 1/1978 Rundell et al. ..... 60/204
4,513,567 A 4/1985 Deveau et al.
5,012,420 A 4/1991 Walker et al.
5,261,228 A 11/1993 Shuba
5,351,473 A 10/1994 Shuba
5,351,732 A * 10/1994 Mills et al. ..... 415/175
6,454,529 B1 9/2002 Zearbaugh et al.
6,626,635 B1 9/2003 Prowse et al.
2004/0239010 A1 * 12/2004 Miura et al. ..... 264/572
2005/0109016 A1 5/2005 Ullyott
2006/0277919 A1 * 12/2006 Martensson et al. ..... 60/785

FOREIGN PATENT DOCUMENTS

GB 1 581 566 12/1980
WO 92/11444 A1 7/1992

OTHER PUBLICATIONS

GB Search Report, App. No. GB0717871.8, Jan. 4, 2008.

* cited by examiner

*Primary Examiner*—Edward Look
*Assistant Examiner*—Jesse Prager
(74) *Attorney, Agent, or Firm*—William Scott Andes, Esq.; Armstrong Teasdale LLP

(57) ABSTRACT

A method for operating a gas turbine engine is provided. The gas turbine engine includes a fan, a high pressure turbine coupled downstream from the fan, and a low pressure turbine downstream from the high pressure turbine. The method includes channeling a portion of air discharged from the fan through a clearance control system including an inlet assembly that includes a plurality of louvers, and directing air from the inlet assembly into a first pipe and second pipe coupled to the inlet assembly such that pressure losses associated with the airflow are facilitated to be reduced.

18 Claims, 5 Drawing Sheets

METHOD AND APPARATUS FOR OPERATING GAS TURBINE ENGINES

BACKGROUND OF THE INVENTION

This invention relates generally to turbine engines and more specifically to clearance control systems used with gas turbine engines.

Known gas turbine engines include an engine casing that extends circumferentially around a compressor, and a turbine that includes a rotor assembly and a stator assembly. Known rotor assemblies include at least one row of rotating blades that extend radially outward from a blade root to a blade tip. A radial tip clearance is defined between the rotating blade tips and a stationary shroud attached to the engine casing.

During engine operation, the thermal environment variations in the engine may cause thermal expansion or contraction of the rotor and stator assemblies. Such thermal expansion or contraction may not occur uniformly in magnitude or rate. As a result, inadvertent rubbing, such as between the rotor blade tips and the casing may occur, or radial clearances may be created that are wider than the design clearances which may adversely affect engine performance. Continued rubbing between the rotor blade tips and engine casing may lead to premature failure of the rotor blade.

To facilitate minimizing inadvertent rubbing between the rotor blade tips and the surrounding shroud or undesirable large radial clearances, at least some known engines include an active clearance control system. The clearance control system channels cooling air to the engine casing to facilitate controlling thermal growth of the engine casing and to facilitate minimizing inadvertent blade tip rubbing. Such cooling air may be channeled from a fan assembly, a booster, or from compressor bleed air sources. The effectiveness of the clearance control system is at least partially dependent upon controlling pressure losses that may occur while the cooling air is channeled towards the engine casing.

BRIEF DESCRIPTION OF THE INVENTION

In one aspect, a method for operating a gas turbine engine is provided. The gas turbine engine includes a fan, a high pressure turbine coupled downstream from the fan, and a low pressure turbine downstream from the high pressure turbine. The method includes channeling a portion of air discharged from the fan through a clearance control system including an inlet assembly that includes a plurality of louvers, and directing air from the inlet assembly into a first pipe and a second pipe coupled to the inlet assembly such that pressure losses associated with the airflow are facilitated to be reduced.

In a further aspect, a turbine assembly is provided. The turbine assembly includes a first rotor assembly including a first case manifold, a second rotor assembly including a second case manifold wherein the second rotor assembly is disposed downstream from the first rotor assembly. The turbine assembly also includes a clearance control system coupled within the turbine assembly and located upstream from the first and second rotor assemblies. The clearance control system includes an inlet assembly, an inlet tube, a first transfer pipe, and a second transfer pipe. The inlet assembly includes a plurality of louvers oriented to direct cooling air into the clearance control system. The inlet tube is coupled to the inlet assembly. The first pipe and the second pipe are coupled in flow communication to the inlet tube such that substantially all of the cooling air discharged from the inlet assembly is channeled into the first and second pipes such that pressure losses of the airflow entering the inlet assembly are facilitated to be reduced.

In a further aspect, a clearance control system for use with a gas turbine engine assembly including a fan, a first rotor assembly downstream from the fan, and a second rotor assembly downstream from the first rotor assembly is provided. The system includes an inlet assembly including a plurality of louvers oriented to channel air discharged from the fan into the inlet assembly. The system also includes a first pipe extending downstream from the inlet assembly and configured to couple to a portion of the high pressure turbine. The system also includes a second pipe extending downstream from the inlet assembly for channeling air discharged from the inlet assembly towards the second rotor assembly. The clearance control system facilitates active clearance control between the first and second rotor assemblies and a stationary component positioned adjacent to the first and second rotor assemblies.

DETAILED DESCRIPTION OF THE INVENTION

Figure 1:
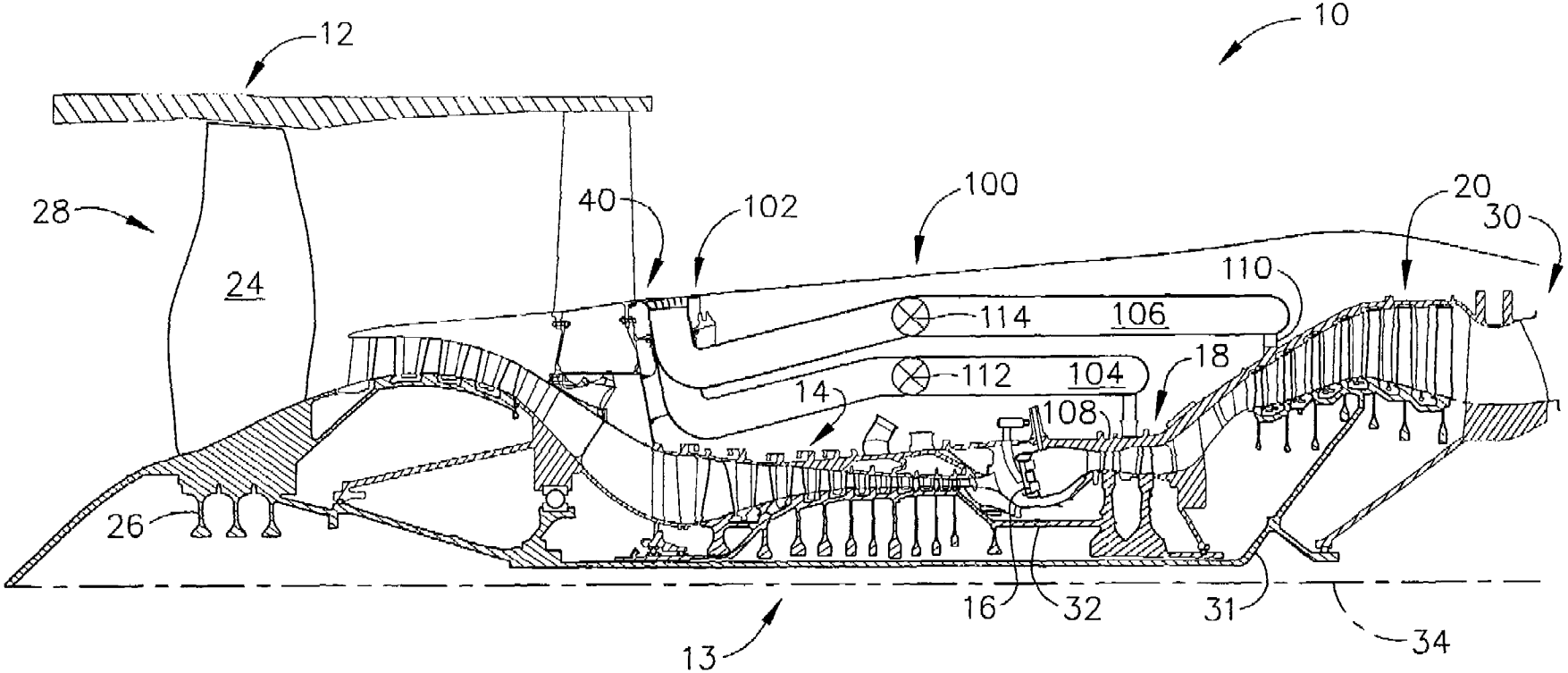
FIG. 1 is a schematic illustration of an exemplary gas turbine engine.

FIG. 1 is a schematic illustration of an exemplary gas turbine engine 10 that includes a fan assembly 12 and a core engine 13 including a high pressure compressor 14, a combustor 16, and a high pressure turbine 18. Engine 10 also includes a low pressure turbine 20. Fan assembly 12 includes an array of fan blades 24 that extend radially outward from a rotor disk 26. Engine 10 has an intake side 28 and an exhaust side 30. Fan assembly 12 and low pressure turbine 20 are coupled by a low speed rotor shaft 31, and compressor 14 and high pressure turbine 18 are coupled by a high speed rotor shaft 32.

Generally, during operation, air flows axially through fan assembly 12, in a direction that is substantially parallel to a central axis 34 extending through engine 10, and compressed air is supplied to high pressure compressor 14. The highly compressed air is delivered to combustor 16. Combustion gas flow (not shown in FIG. 1) from combustor 16 drives turbines 18 and 20. Turbine 18 drives compressor 14 by way of shaft 32 and turbine 20 drives fan assembly 12 by way of shaft 31.

Gas turbine engine 10 also includes an active clearance control system 100. In the exemplary embodiment, clearance control system 100 is coupled to a fan frame hub 40 associated with fan blades 24, and clearance control system 100 includes an inlet assembly 102 and at least two active clearance control supply pipes 104 and 106. Specifically, in the exemplary embodiment, a first active clearance control supply pipe 104 and a second active clearance control supply pipe 106 extend downstream from inlet assembly 102 to channel airflow towards a portion of high pressure turbine 18 and low pressure turbine 20, respectively. Specifically, in the exemplary embodiment, first pipe 104 is coupled to high pressure turbine casing manifold 108, and second pipe 106 is coupled to low pressure turbine casing manifold 110. In the exemplary embodiment, first pipe 104 includes a first control valve 112 and second pipe 106 includes a second control valve 114. Valves 112 and 114 each modulate airflow during engine operation.

Figure 2:
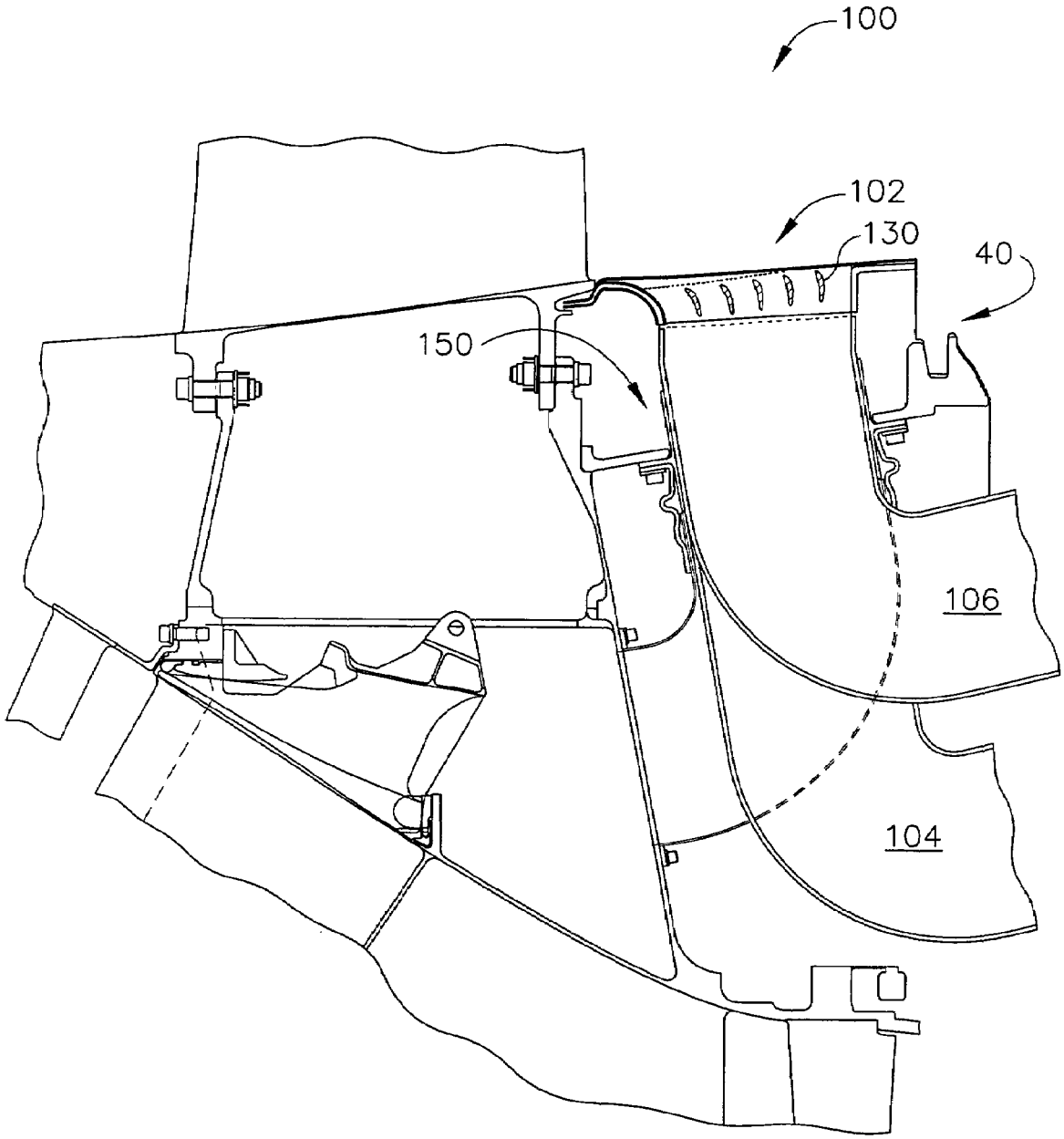
FIG. 2 is an enlarged schematic illustration of a portion of the gas turbine engine shown in FIG. 1.
Figure 3:
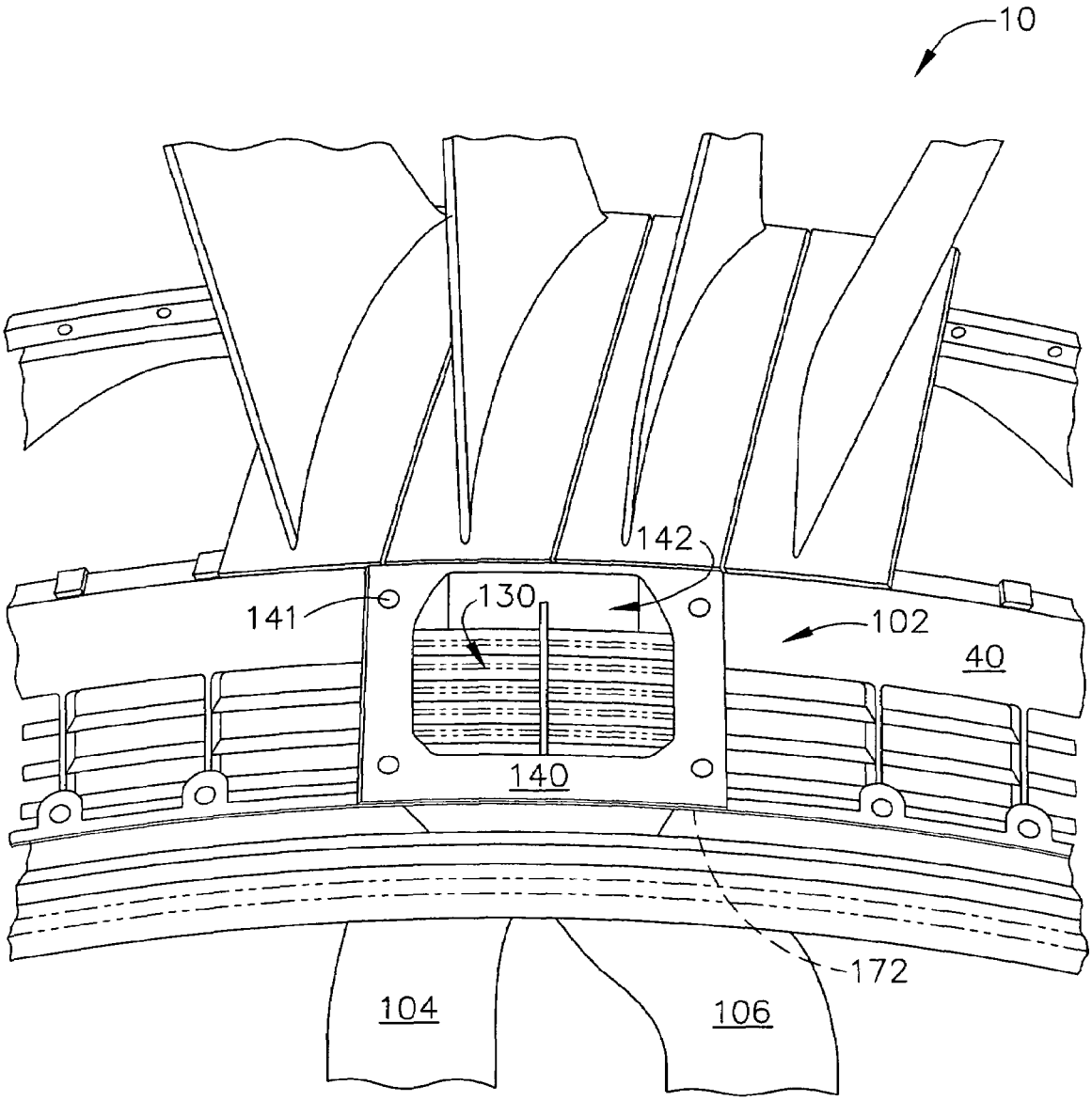
FIG. 3 is a front view of a portion of a clearance control system shown in FIG. 2.
Figure 4:
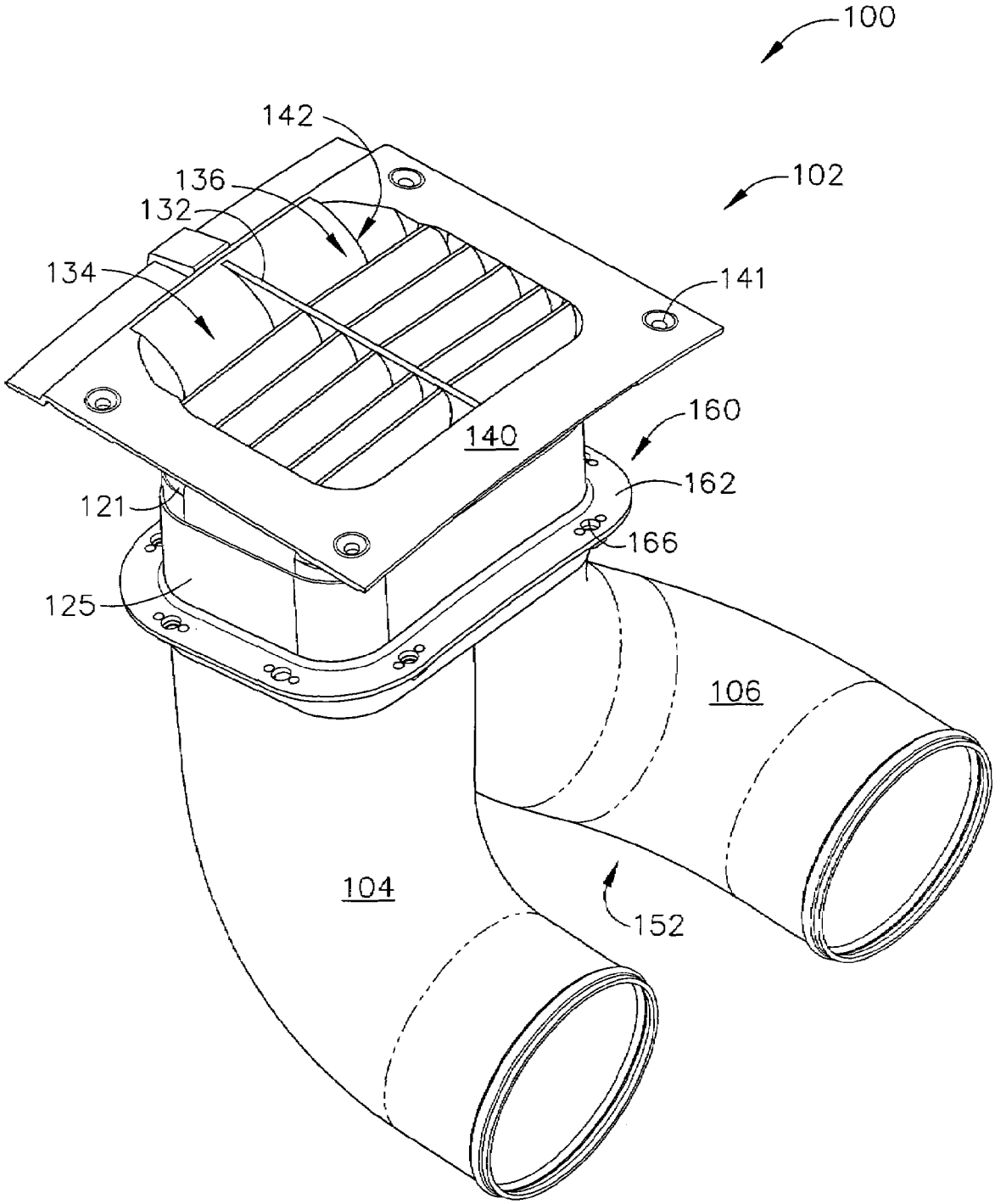
FIG. 4 is a perspective view of a portion of the clearance control system shown in FIG. 2 and including an inlet assembly.
Figure 5:
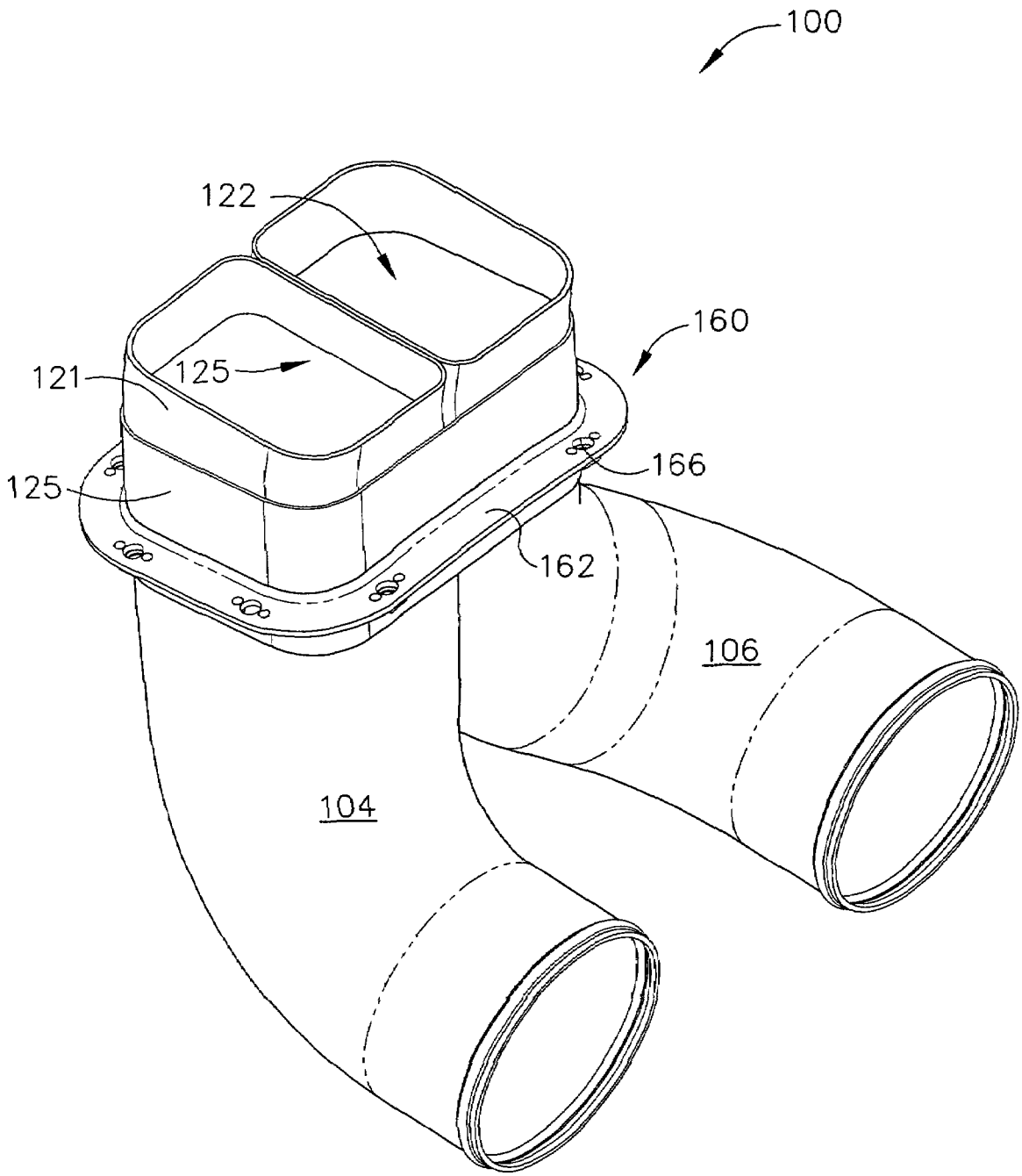
FIG. 5 is a perspective view of the portion of the clearance control system shown in FIG. 4 without the inlet assembly.

FIG. 2 is an enlarged schematic illustration of a portion of clearance control system 100, and FIG. 3 is a front view of a portion of clearance control system 100. FIG. 4 is a perspective view of a portion of clearance control system 100 including inlet assembly 102, and FIG. 5 is the same perspective view of the clearance control system 100 illustrated in FIG. 4 but without inlet assembly 102.

Inlet assembly 102 is coupled to a portion of fan frame hub 40 to channel air discharged from fan assembly 12 towards high pressure turbine 18 and low pressure turbine 20 to facilitate controlling thermal expansion of first and second casing manifolds 108 and 110. More specifically, as shown in FIG. 4, inlet assembly 102 is sealingly coupled to an inlet tube 121 to enable air entering inlet assembly 102 to enter a partitioned supply plenum 125 through inlet tube 121. Plenum 125 is coupled to first and second pipes 104 and 106 such that air entering plenum 125 is directed into first and second pipes 104 and 106. In the exemplary embodiment, plenum 125 circumscribes the exterior of pipes 104 and 106. As such, all air entering plenum 125 is directed into pipes 104 and 106 and plenum 125 facilitates supporting pipes 104 and 106 in proper alignment with respect to each other.

In the exemplary embodiment, a portion of air discharged from the fan blades 24, is channeled through an intake side 122 of inlet assembly 102 for delivery into pipes 104 and 106. Specifically, in the exemplary embodiment, air intended for use with pipes 104 and 106 enters inlet assembly 102 from the same circumferential location, i.e. a single inlet location, for use with both high pressure turbine 18 and low pressure turbine 20. The use of a single inlet location facilitates reducing the complexity of clearance control system 100. In one embodiment, the single inlet location is located adjacent an outlet guide vane hub exit.

Inlet assembly 102 includes a plurality of louvers 130 that are aerodynamically designed and oriented to channel air from the fan discharge stream into inlet assembly 102 such that the air captured maintains a higher pressure facilitating optimizing dynamic head recovery of the captured air. Specifically, in the exemplary embodiment, louvers 130 are oriented at an angle with respect to central axis 34 of engine 10 that enables air to be "scooped" or channeled from the fan discharge stream. In the exemplary embodiment, louvers 130 are semi-elliptically-shaped and are oriented to channel a portion of the fan discharge stream into inlet assembly 102. Alternatively, louvers 130 may be of any suitable shape and/or may be positioned at any suitable angle within inlet assembly 102 that enables clearance control system 100 to function as described herein. The shape and position of louvers 130 facilitates increasing the pressure of the air that may be captured from the fan discharge stream. Additionally, as shown in FIG. 4, in the exemplary embodiment, a separator 132 extends across inlet assembly 102 such that a first set of louvers 134 and a second set of louvers 136 are defined with inlet assembly 102. In the exemplary embodiment, first set of louvers 134 channel airflow into first pipe 104 and second set of louvers 136 channel airflow into second pipe 106. In the exemplary embodiment, first and second pipes 104 and 106 each have a substantially constant cross-sectional area along the length of first pipe 104 and second pipe 106.

Inlet assembly 102 also includes an anchor plate 140 that circumscribes inlet assembly 102 adjacent intake side 122. More specifically, in the exemplary embodiment, anchor plate 140 is positioned upstream from louvers 130. Anchor plate 140 includes a plurality of openings 141 that are sized to receive at least one fastening mechanism (not shown) therethrough for coupling inlet assembly 102 to fan frame hub 40. In the exemplary embodiment, anchor plate 140 also includes a contoured inlet wall 142 that assists in channeling air into inlet assembly 102 with an enhanced pressure recovery. Countered inlet wall 142 extends into both sets of louvers 134 and 136. Inlet tube 121 extends in sealing contact between anchor plate 140 and plenum 125. The combination of inlet tube and plenum 125 facilitates reducing significant pressure losses of air by channeling the air directly from inlet assembly 102 into pipes 104 and 106 without passing through a dead air gap, as is common in known active control systems.

In the exemplary embodiment, each pipe 104 and 106 extends from plenum 125 and includes at least one bend 152 that turns air flowing therein. In the exemplary embodiment, the smooth curvature of each bend 152 facilitates channeling air through pipes 104 and 106 while minimizing pressure losses therein. Furthermore, the orientation, configuration, and size of contoured inlet wall 142, inlet tube 121, and plenum 125 also facilitate preventing pressure losses of air channeled therethrough.

In the exemplary embodiment, plenum 125 also includes retaining member 160 that circumscribes the exterior of pipes 104 and 106, and plenum 125. Retaining member 160 facilitates enhancing the structural support to pipes 104 and 106 and facilitates aligning pipes 104 and 106 with respect to each other. Specifically, in the exemplary embodiment, pipes 104 and 106 are adjacent each other near inlet assembly 102 and separate a distance apart as pipes 104 and 106 extend outward from inlet assembly 102 towards turbines 18 and 20.

In the exemplary embodiment, retaining member 160 is coupled to fan frame hub 40. Specifically, retaining member 160 circumscribes plenum 125 and includes a lip 162 that includes a plurality of openings 166 that are each sized to receive retaining mechanisms (not shown) therethrough to enable retaining member 160 to be coupled to fan frame hub 40.

During assembly, inlet assembly 102 is coupled to inlet tube 121 in a sealed joint. Inlet tube 121 is then coupled to plenum 125 and pipes 104 and 106 are each coupled to plenum 125. In the exemplary embodiment, plenum 125 is coupled to pipes 104 and 106 in a sealed joint to facilitate preventing air from leaking out of inlet assembly 102 and into a cowl support plenum 150.

Clearance control system 100 is then coupled to fan frame hub 40 with a plurality of retaining mechanisms (not shown) inserted through openings 141. Additionally, retaining mechanisms are inserted through openings 166 to couple plenum 125 and retaining member 160 to fan frame hub 40. Specifically, retaining member 160 is positioned adjacent an inner portion 172 of fan frame hub 40 and retaining mechanisms are used to secure retaining member 160 to inner portion 172 such that lip 162 contacts inner portion 172.

During operation, a portion of air discharged from fan blades 24 is channeled from fan assembly 12 towards clearance control system 100. Specifically, air discharged from fan assembly 12 is directed into clearance control system 100 through inlet assembly 102 and at a single inlet location. Air entering inlet assembly 102 is discharged downstream towards high pressure turbine casing manifold 108 and low pressure turbine casing manifold 110. Louvers 130 facilitate channeling air discharged from fan assembly 12 into clearance control system 100. The aerodynamic shape of louvers 130 facilitates capturing air from the fan discharge stream while maintaining an enhanced pressure recovery for the air entering clearance control system 100. The efficiency of clearance control system 100 is at least partially dependent on system pressure ratio and pressure recovery. Additionally, contoured inlet wall 142 aids in channeling a portion of the fan discharge stream into inlet system 102 such that the captured air from the fan stream has enhanced pressure when the air enters into clearance control system 100. Once air has entered inlet assembly 102, air is channeled through inlet tube 121 and into plenum 125. Plenum 125 provides a sealed area for air to flow into first and second pipes 104 and 106. Moreover, tube 121 and plenum 125 prevent air entering inlet assembly 102 from leaking out of clearance control system 100. Air is then channeled from plenum 125 into pipes 104 and 106.

In the exemplary embodiment, air flows through each pipe 104 and 106 towards turbines 18 and 20. The smooth curvature of bends 152 facilitates guiding the air into pipes 104 and 106 such that pressure losses associated with channeling the airflow are facilitated to be reduced. Air in pipes 104 and 106 flows toward each respective control valve 112 and 114. In the exemplary embodiment, control valves 112 and 114 are fully modulated and each valve 112 and 114 may be in either an open position or a closed position. When in the open position, cooling air continues to flow through pipes 104 and 106 towards respective manifolds 108 and 110. Directing cooling air towards manifolds 108 and 110 facilitates controlling thermal expansion of the rotor and stator assemblies. As a result, tighter blade clearances within turbines 18 and 20 are achieved through enhanced control and cooling of case manifold 108 and 110. As such, engine 10 performance is enhanced.

The method for operating a gas turbine engine herein includes channeling a portion of air discharged from the fan through a clearance control system including an inlet assembly that includes a plurality of louvers, and directing air from the inlet assembly into a first pipe and second pipe coupled to the inlet assembly such that pressure losses associated with the airflow are facilitated to be reduced.

The clearance control system described herein facilitates maintaining a clearance gap defined between static casing assemblies and adjacent rotating components. Cooling air supplied towards the static casing assemblies from the clearance control system can come from any cooling source inside the engine. Moreover, the clearance control system facilitates enhanced control of thermal expansion rates, which ultimately facilitates maintaining tighter clearances during engine operation.

The above-described clearance control system provides a cost-effective and reliable means for increasing the source pressure for turbines than known bleed air systems without negatively impacting bypass fan efficiency. This is achieved by directing air from the fan stream into bleed air system at the same bleed location to increase the amount of pressure within the air captured from the fan stream. Additionally, the shape and position of louvers increases the pressure captured from the fan stream. Furthermore, contoured inlet wall, inlet tube, and gentle bend prevent pressure loss once air from the fan stream has entered bleed air system. Thus, the clearance control system facilitates increasing turbine efficiency a cost-effective and reliable manner.

An exemplary embodiment of a bleed air system for a clearance control system is described above in detail. The system illustrated is not limited to the specific embodiments described herein, but rather, components of each system may be utilized independently and separately from other components described herein.

While the invention has been described in terms of various specific embodiments, those skilled in the art will recognize that the invention can be practiced with modification within the spirit and scope of the claims.

What is claimed is:

1. A method for operating a gas turbine engine including a fan, a high pressure turbine coupled downstream from the fan, and a low pressure turbine downstream from the high pressure turbine, said method comprising:

channeling a portion of air discharged from the fan through a clearance control system including an inlet assembly that includes a plurality of louvers; and directing air from the inlet assembly including a flow separator that separates a first set of louvers and a second set of louvers, said first set of louvers is configured to channel airflow into a first pipe and said second set of louvers is configured to channel airflow into said second pipe, said first and second pipes coupled to the inlet assembly such that pressure losses associated with the airflow are facilitated to be reduced.

2. A method in accordance with claim 1, wherein channeling a portion of air discharged from the fan further comprises channeling air through a single inlet location for use with both the clearance control system.

3. A method in accordance with claim 1 further comprising orienting the plurality of louvers to minimize pressure losses of air entering the inlet assembly.

4. A method in accordance with claim 1, wherein the clearance control system includes an inlet tube and a plenum, said method further comprises coupling the inlet tube to the inlet assembly such that substantially all of the air channeled into the inlet assembly is discharged directly into the inlet tube.

5. A method in accordance with claim 4 further comprising directing substantially all of the air entering the inlet tube into the plenum prior to channeling the airflow towards the high and low pressure turbines.

6. A turbine assembly comprising:

a first rotor assembly comprising a first case manifold;

a second rotor assembly comprising a second case manifold, said second rotor assembly being disposed downstream from said first rotor assembly;

a clearance control system coupled within said turbine assembly upstream from said first and second rotor assemblies, said clearance control system comprising an inlet assembly, an inlet tube, a first transfer pipe, and a second transfer pipe, said inlet assembly comprises a plurality of louvers oriented to direct cooling air into said clearance control system, said inlet tube is configured to couple to said inlet assembly, said first pipe and said second pipe are coupled in flow communication to said inlet tube such that substantially all of the cooling air discharged from said inlet assembly is channeled into said first and second pipes such that pressure losses of the airflow entering said inlet assembly are facilitated to be reduced, said clearance control system further comprising a retaining member that circumscribes said first and second pipes and facilitates aligning said first and second pipes with respect to said inlet assembly.

7. A gas turbine engine in accordance with claim 6 wherein said inlet assembly provides cooling air to said first and second rotor assemblies.

8. A gas turbine engine in accordance with claim 6 wherein said plurality of louvers are oriented to channel cooling air into said inlet assembly such that pressure losses of the cooling air are facilitated to be reduced.

9. A gas turbine engine in accordance with claim 6 wherein said inlet assembly further comprises a contoured inlet that facilitates reducing pressure losses of airflow entering said inlet assembly.

10. A gas turbine engine in accordance with claim 9 wherein said clearance control system further comprises an inlet tube extending from said inlet assembly to said first and second pipes, said inlet tube facilitates reducing pressure losses within said clearance control system.

11. A gas turbine engine in accordance with claim 6 wherein said inlet assembly further comprises a flow separator that separates a first set of louvers and a second set of louvers, said first set of louvers is configured to channel airflow into said first pipe, said second set of louvers is configured to channel into said second pipe.

12. A gas turbine engine in accordance with claim 6 further comprising a plenum configured to discharge airflow entering said inlet assembly into said first and second pipes.

13. A gas turbine engine in accordance with claim 6 wherein each of said first and second pipes comprises a control valve for use in controlling airflow therethrough.

14. A gas turbine engine in accordance with claim 6 wherein said each said first and second pipe comprises a substantially constant cross-sectional area along the length of said first and second pipes to facilitate reducing pressure losses within said clearance control system.

15. A clearance control system for use with a gas turbine engine assembly including a fan, a first rotor assembly downstream from the fan, and a second rotor assembly downstream from the first rotor assembly, said system comprising:

an inlet assembly comprising a plurality of louvers oriented to channel air discharged from the fan into said inlet assembly;

a first pipe extending downstream from said inlet assembly and configured to couple to a portion of the high pressure turbine; and a second pipe extending downstream from said inlet assembly for channeling air discharged from said inlet assembly towards said second rotor assembly, said clearance control system facilitates active clearance control between said first and second rotor assemblies and a stationary component positioned adjacent to said first and second rotor assemblies, wherein said inlet assembly further comprises a flow separator that separates a first set of louvers and a second set of louvers of said plurality of louvers, said first set of louvers is configured to channel airflow into said first pipe, said second set of louvers is configured to channel into said second pipe.

16. A system in accordance with claim 15 further comprising a plenum configured to discharge airflow entering said inlet assembly into said first and second pipes.

17. A system in accordance with claim 15 wherein said inlet assembly further comprises a contoured inlet that facilitates reducing pressure losses of airflow entering said inlet assembly.

18. A system in accordance with claim 15 further comprising an inlet tube configured to couple to said inlet assembly, said first pipe and said second pipe are configured to couple in flow communication to said inlet tube such that substantially all of the cooling air discharged from said inlet assembly is channeled into said first and second pipes such that pressure losses of the airflow entering said inlet assembly are facilitated to be reduced.

* * * * *